US006437744B1

(12) United States Patent
Akiyama et al.

(10) Patent No.: US 6,437,744 B1
(45) Date of Patent: Aug. 20, 2002

(54) CIRCULARLY POLARIZED WAVE ANTENNA DEVICE

(75) Inventors: Hisashi Akiyama, Yokohama; Kazunari Kawahata, Machida; Shigekazu Itoh, Ishikawa-ken; Atsuyuki Yuasa, Sagamihara, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/954,361

(22) Filed: Sep. 17, 2001

(30) Foreign Application Priority Data

Sep. 20, 2000 (JP) ..... 2000-285318

(51) Int. Cl.[7] ..... H01Q 1/38
(52) U.S. Cl. ..... 343/700 MS; 343/702
(58) Field of Search ..... 343/700 MS, 702, 343/846, 848; H01Q 1/38, 1/24

(56) References Cited

U.S. PATENT DOCUMENTS 5,784,032 A * 7/1998 Johnston et al. ..... 343/702
6,100,849 A * 8/2000 Tsubaki et al. ..... 343/702
6,140,968 A * 10/2000 Kawahata et al. ... 343/700 MS

FOREIGN PATENT DOCUMENTS

JP 0183637 3/2000

* cited by examiner

*Primary Examiner*—Hoanganh Le
(74) *Attorney, Agent, or Firm*—Ostrolenk, Faber, Gerb & Soffen, LLP

(57) ABSTRACT

A circularly polarized wave antenna device that has improved the orthogonality of two radiation electric fields in a degeneration-separated mode. A radiation conductor is formed on one main surface of a substrate, and a ground conductor is formed on the other main surface of the substrate opposite to the radiation conductor. A feeding conductor is formed on the side surface of the substrate so as to extend from the other main surface toward the one main surface. The radiation conductor is formed into a square shape or an electrically square shape in a plan view. On the substrate, capacitive loading conductors are provided in the extended directions of the two diagonal lines of the radiation conductor, the capacitive loading conductors being formed between the ground conductor and the radiation conductor, and having mutually different shapes between the one diagonal direction and the other diagonal direction.

20 Claims, 6 Drawing Sheets

CIRCULARLY POLARIZED WAVE ANTENNA DEVICE

BACKGROUND OF THE INVENTION

1. Field of the Invention

The present invention relates to a circularly polarized wave antenna device used for e.g., communication equipment of a mobile unit.

2. Description of the Related Art

Satellite communication using an artificial satellite is being utilized in aircraft, cars, etc. and employs circularly polarized radio waves in order to eliminate regional difference. Particularly, small-sized circularly polarized wave antenna devices are required as antennas for radio equipment using circularly polarized waves, such as GPS (Global Positioning System), DAB (Digital Audio Broadcast) using S-band, ETC (Electrical Toll Collection) or the like. To meet this requirement, the present applicant has proposed a surface-mount circularly polarized wave antenna device and radio equipment using the same, in Japanese Patent Application Publication No. 2000-183637. FIG. 11 shows the circularly polarized antenna proposed in the above-mentioned patent application.

In FIG. 11, the circularly polarized antenna has a flat-plate shaped substrate formed of a dielectric body. On one main surface of this substrate 1, radiation conductor 2 which has a substantially rectangular shape in a plan view, and of which two diagonally opposite comer portions are cut off, is formed, while, on the other main surface thereof, a ground conductor 3 is formed substantially over the entire surface, except for a wraparound portion of a feeding conductor as described later. On one side surface of the substrate 1, there is provided a strip-shaped feeding conductor 4 which extends from the main surface on which the ground conductor 3 is formed, to the main surface on which the radiation conductor 2 is formed, and each of the ends of the feeding conductor 4 are formed so as to wrap around one of the main surfaces. On opposite sides of the feeding conductor 4, capacitive loading conductors 5 and 6 are formed substantially over the entire remaining surfaces while securing electrical isolation from the feeding conductor 4, and these capacitive loading conductors 5 and 6 are connected to the ground conductor 3.

In the circularly polarized wave antenna device with these features, a stray capacitance is formed between the feeding conductor 4 and the radiation conductor 2, while a load capacitance or an electrostatic capacitance is formed between each of the capacitance loading conductors 5 and 6 and the radiation conductor 2. In this case, since the corner portion of the radiation conductor 2 on the capacitive loading conductor 6 side is cut off, a load capacitance or an electrostatic capacitance between the capacitive loading conductors 6 and the radiation conductor 2 is smaller than that between the capacitive loading conductors 5 and the radiation conductor 2 .

When the power of a transmitting signal is supplied to the feeding conductor 4, a resonant current in a linear polarization mode does not flow through the radiation conductor 2, but resonant currents separated into two resonant circuits, that is, a high-frequency resonant circuit formed by the radiation conductor 2 and the capacitive loading conductor 5, and that formed by the radiation conductor 2 and the capacitive loading conductor 6, in other words, resonant currents in a degeneration-separated mode flow through the radiation conductor 2. These two resonant currents in the degeneration-separated mode have a predetermined phase difference θ1, generate two radiation electric fields having mutually different frequencies (f1 and f2), and radiate circularly polarized electromagnetic waves from the radiation conductor 2 in the normal direction thereto.

However, in the circularly polarized wave antenna with the above-described features, the width L of the capacitive loading conductors 5 and 6 with respect to the length of the edge 2*a* of the radiation conductor 2 is large, so that the paths through which two resonant currents in the degeneration-separated mode flow, depends on the width L of the capacitive loading conductors 5 and 6, the width L determining the load capacitance or electrostatic capacitance between the radiation conductor 2 and each of the capacitive loading conductors 5 and 6. As a consequence, two radiation electric fields in the degeneration-separated mode do not have a phase difference of 90° therebetween, and the two radiation electric fields do not spatially intersect each other orthogonally. This results in elliptically polarized waves, and causes deterioration of the antenna characteristic.

Also, since the feeding conductor 4 and each of the capacitive loading conductors 5 and 6 are close to each other, the electromagnetic coupling between the feeding conductor 4 and each of the capacitive loading conductors 5 and 6 becomes large, and thereby the power of transmitting/receiving signals using the radiation conductor 2 becomes small, so that it is necessary accordingly to increase the power of transmitting/receiving signals to be supplied to the feeding conductor 4.

Furthermore, under the condition that the dielectric constant of the substrate 1 is constant, when the area of the capacitive loading conductors 5 and 6 is increased, the load capacitance or electrostatic capacitance between the radiation conductor 2 and each of the capacitive loading conductors 5 and 6 becomes large, so that the resonant frequency in the degeneration-separated mode decreases. This causes a problem in that a desired frequency cannot be obtained.

SUMMARY OF THE INVENTION

The present invention has been achieved to solve the above problems, and an object of the present invention to provide a circularly polarized wave antenna device which has improved the orthogonality of two radiation electric fields in the degeneration-separated mode.

In order to achieve the above-described object, the present invention uses the following configurations to solve the above-described problems. The circularly polarized wave antenna device in accordance with a first aspect of the invention comprises a substrate formed of dielectric material; a radiation conductor having a quadrangular shape in plan view, the radiation conductor being formed on one main surface of the substrate; a ground conductor formed on the other main surface of the substrate, the other main surface being opposed to the radiation conductor; and a feeding conductor formed on the substrate so as to extend from the other main surface toward the one main surface. In this circularly polarized wave antenna device, the radiation conductor is formed into a shape wherein the electric lengths in two orthogonal directions on the radiation conductor are equal to each other. On the substrate, capacitive loading conductors which generate load capacitance between the radiation conductor and the capacitive loading conductors, are provided at positions in the diagonal directions on the radiation conductor, the load capacitance determining the frequency difference between two resonant currents flowing through the radiation conductor.

The circularly polarized wave antenna device in accordance with a second aspect of the present invention comprises a substrate formed of dielectric material; a radiation conductor formed on one main surface of the substrate; a ground conductor formed on the other main surface of the substrate, the other main surface being opposed to the radiation conductor; and a feeding conductor formed on a side surface of the substrate so as to extend from the other main surface toward the one main surface. In this circularly polarized wave antenna device, the radiation conductor is formed into a square shape in a plan view, or an electrical square shape in a plan view. On the substrate, capacitive loading conductors which are formed between the ground conductor and the radiation conductor, and which have mutually different shapes between one of the diagonal direction and the other thereof, are provided at the extended positions of the two diagonal lines on the radiation conductor or in the vicinity thereof.

In the circularly polarized wave antenna device in accordance with the present invention, the configuration may be such that the substrate is formed into a hexahedron having two main surfaces and four side surfaces; that each of the capacitive loading conductors is disposed on the side surface on which the feeding conductor is provided, along the edge line between the above-mentioned side surface and adjacent side surface adjacent thereto, and that the length of one of the capacitive loading conductors of which one end is connected to the ground conductor, is made shorter than that of the other of the capacitive loading conductors; and that, on the side surface opposite the side surface on which the feeding conductor is provided, capacitive loading conductors which have the same length as that of the capacitive loading conductors in the diagonal directions on the main surface, are each disposed along the edge line between the side surface and adjacent side surfaces.

Also, in the circularly polarized wave antenna device in accordance with the present invention, preferably, each of the capacitive loading conductors is formed by dividing it into a plurality of capacitive loading conductor pieces with gaps interposed therebetween.

Further, in the circularly polarized wave antenna device in accordance with the present invention, it is preferable that the radiation conductor have radiation conductor extension pieces each extending downward from a comer portion of the radiation conductor along the edge line between adjacent side surfaces; and that the radiation conductor extension pieces be formed so as to have different gaps between the radiation conductor extension pieces and the capacitive loading conductors, between the two different diagonal directions.

Moreover, in the circularly polarized wave antenna device in accordance with the present invention, preferably, at least one of the capacitive loading conductors is formed so as to extend to the main surface on which the radiation conductor is formed.

Furthermore, in the circularly polarized wave antenna device in accordance with the present invention, preferably, each of the capacitive loading conductors is formed into a meander shape.

Also, in the circularly polarized wave antenna device in accordance with the present invention, preferably, the substrate is formed into a rectangular parallelepiped.

In the circularly polarized wave antenna device with the above-described features in accordance with the first aspect, since the surface shape of the radiation conductor is one wherein the electric lengths in two orthogonal directions of the radiation conductor are equal to each other, the surface of the radiation conductor is formed as a square by a visual observation, or as an electrical square wherein the electric lengths of two sides are equal. The diagonal directions of the square by a visual observation are orthogonal to each other. On the other hand, the electrical square is rectangular by a visual observation, but the diagonal directions of this rectangle by a visual observation are electrically orthogonal to each other.

By using this radiation conductor, the occurrence of the degeneration-separated mode generated when inputting a transmission power from the feeding conductor to the radiation conductor, is conditioned by the geometries of the radiation conductor and the capacitive loading conductors and the correlational positions therebetween. Specifically, by disposing capacitive loading conductors in the diagonal directions of the radiation conductor, and by making a difference between the capacitive loading conductors in the diagonal directions, an equivalent resonant circuit wherein a resonant current flow in each of the diagonal directions, is formed, and the directions in which resonant currents in the radiation conductor flow are determined. In other words, the degree that two electric fields (polarized waves) using resonant currents as an exciting source spatially intersect each other orthogonally, is determined.

Furthermore, by selecting the geometry of the capacitive loading conductors and the correlational positions between the radiation conductor and each of the capacitive loading conductors, the load capacitance values which vary in the capacitance value for every diagonal direction, are determined. The load capacitance constitutes a circuit element which determines the frequency difference between the two electric fields (polarized waves). In the radiation conductor in which the diagonal directions are orthogonal to each other, and which has a shape such that the electric lengths of two sides thereof are equal, two resonant currents in the degeneration-separated mode exhibit a phase difference of about 90° therebetween, and the phase difference between the polarized waves also becomes about 90°.

As described above, in the present invention, since the phase difference between the two polarized waves can be made about 90°, and the polarized waves can be made to spatially intersect each other substantially orthogonally, it is possible to obtain an antenna which radiates circularly polarized electromagnetic waves from the radiation conductor.

Here, the "electric length of the radiation conductor" refers to the half length of an effective wavelength, in other words, a half length of the wavelength of an electromagnetic wave radiated from an antenna, divided by the root of the dielectric constant of the substrate. Also, the "degeneration separated mode" refers to exciting two resonant currents which have mutually different phases and frequencies, on the radiation conductor, by a single power feeding.

In the circularly polarized wave antenna device with in accordance with the second aspect, since the shape of the radiation conductor is formed into a square shape in a plan view or an electrical square shape in a plan view, and the capacitive loading conductors are provided so that the load capacitances are mutually different between the two diagonal directions, two resonant currents in the degeneration separated mode are excited by the power feeding from a single point except for the two diagonal directions, to the radiation conductor, as well as the directions in which the resonant currents flow are determined, and the polarized waves generated by these resonant currents spatially intersect each other substantially orthogonally. Also, the two resonant currents becomes ones which are mutually different in the resonant frequency and have a phase difference of about 90° therebetween, and thereby the phase difference between the polarized waves having mutually different resonant frequencies, becomes about 90°.

The above-described resonant frequencies, in other word, the frequencies of polarized waves, are subjected to the influences of the load capacitances between the radiation conductor and each of the capacitive loading conductors, particularly the influence of the gap between the radiation conductor and each of the capacitive loading conductors, so that, by setting, to a desired value, the gap between the radiation conductor and each of the capacitive loading conductors and the geometry of the capacitive loading conductors, particularly the length and width, it is possible to set the frequency of polarized waves to meet a required antenna characteristic, and to select the frequency of electromagnetic waves to be radiated from the radiation conductor.

In the configuration wherein the substrate is formed into a hexahedron, and wherein the capacitive loading conductors having the same length in the same diagonal direction on the main surface, are provided along the edge lines of the side surfaces of the substrate, the operation of the degeneration-separated mode is determined by the structure of the antenna. Specifically, by disposing the capacitive loading conductors as closely along the edge lines of the side surfaces of the substrate as possible, two polarized waves having a phase difference of approximately 90° can be made to spatially intersect each other substantially orthogonally. In addition, by forming the substrate as a hexahedron, the substrate can be formed to fit the shape of the substrate. Among alternatives, when a substrate having a square shaped main surface is adopted, the shape of the radiation conductor in a plan view and the shape of the main surface becomes the same, so that the substrate can be formed into the minimum size. In accordance with the present invention, the circularly polarized antenna device can be reduced in overall size.

The configuration of the capacitive loading conductors formed on the substrate can be determined in consideration of a required antenna characteristic, and consequently, the load capacitance corresponding to the frequency of the electromagnetic waves radiated from the radiation conductor. When forming each of the capacitive loading conductors by dividing them into a plurality of capacitive loading conductor pieces with gaps interposed therebetween, the load capacitance decreases, so that the frequency of the electromagnetic waves radiated from the antenna can be set to a high value.

In the configuration wherein, by extending the corners of the radiation, radiation conductor extension pieces are formed so as to extend downward to the side surface edges of the substrate, the load capacitance is mainly formed between each of the radiation conductor extension pieces and one of the capacitive loading conductor pieces, and desired load capacitance can be set by setting the gap.

In the configuration wherein the capacitive loading conductor is extended to the main surface on which the radiation conductor is formed, since the load capacitance or the electrostatic capacitance between the radiation conductor and each of the capacity loading conductors becomes large, the frequency of electromagnetic waves radiated from the radiation conductor can be reduced. Also, in the configuration wherein the capacitive loading conductors are formed into a meander shape, an inductance component can be added in addition to a capacitive component when attempting to determine the resonant frequency of the two currents in the degeneration-separated mode, in other words, the frequency of two polarized waves. In any of the above-described cases, if the substrate is formed as a rectangular parallelepiped, and the capacitive loading conductor is formed so as to have a small width, circularly polarized waves in the degeneration-separated mode which spatially intersect each other substantially orthogonally, and which have a phase difference of about 90° therebetween, will be ensured.

The above and other objects, features, and advantages of the present invention will be clear from the following detailed description of the preferred embodiments of the invention in conjunction with the accompanying drawings.

BRIEF DESCRIPTION OF THE DRAWING(S)

FIGS. 1A and 1B are perspective views showing a circularly polarized wave antenna device in accordance with the present invention, wherein FIG. 1A is a view seen from the front surface side thereof, and FIG. 1B is a view seen from the rear surface side thereof;

DETAILED DESCRIPTION OF EMBODIMENTS OF THE INVENTION

Figure 1A:
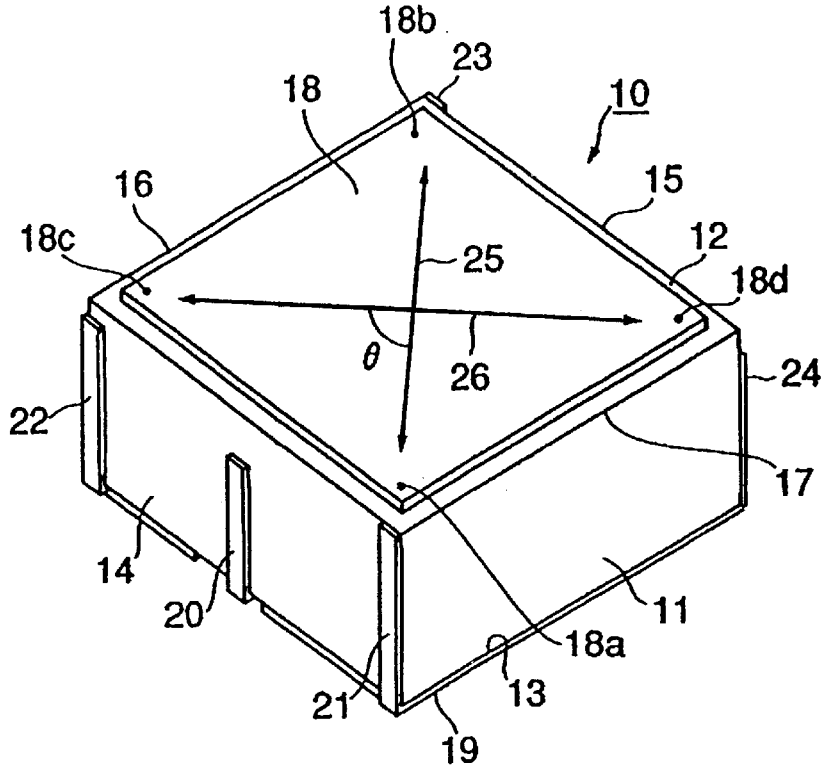
Figure 1B:
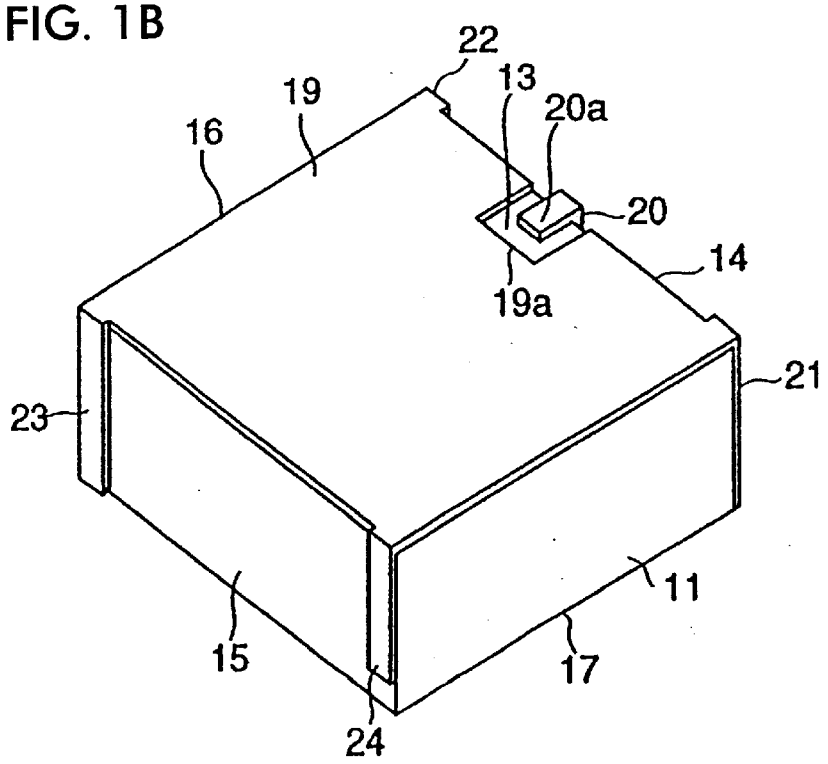

FIG. 1A is a perspective view showing a circularly polarized wave antenna device viewed from the front surface side, and FIG. 1B is a perspective view showing a circularly polarized wave antenna device viewed from the rear surface side. The substrate 11 of the circularly polarized wave antenna device 10 is formed as a hexahedron. A radiation conductor 18 having a square shape in a plan view is formed on one main surface 12 of the substrate 11, and a ground conductor 19 is formed substantially over the entire other main surface 13 opposite to the one main surface 12. Both main surfaces 12 and 13 of the substrate 11 are each formed as a square, and two diagonal lines of each of the main surfaces 12 and 13 overlap the two diagonal lines of the radiation conductor 18.

On the first side surface 14 of the substrate 11, a strip shaped feeding conductor 20 is formed so as to extend from the main surface 13 side on which a ground conductor 19 is provided, toward the main surface 12 on which the radiation conductor 18 is provided. The feeding conductor 20 is disposed so that the extension line thereof toward the radiation conductor 18 passes through the point of intersection of the two diagonal lines on the radiation conductor 18, and that the tip of the extension line orthogonally intersects one of the sides of the radiation conductor 18. The end portion (lower end) of the feeding conductor 20 on the ground conductor 19 side is extended so as to wrap around the other main surface 13 on which the ground conductor 19 is provided, and constitutes a feeding terminal electrode 20*a*, which is to be connected to the circuit board (not shown) of radio equipment. Around this terminal electrode 20*a*, there is provided a notch 19*a*, which is formed by cutting off the ground conductor 19 by a given width. The notch 19*a* exposes a portion of the other main surface 13 of the substrate 11, and thereby electrically isolates the feeding terminal electrode 20*a* from the ground conductor 19.

The first side surface 14 on which the feeding electrode is provided, of the substrate 11 constitutes a rectangular side surface, and on the short side portions situated on opposite sides of the feeding conductor 20, strip shaped capacitive loading conductors 21 and 22 are each formed along an edge line. The positions at which the capacitive loading conductors 21 and 22 are provided, correspond to the positions on the first side surface 14 to which the diagonal lines of the radiation conductor 18 are extended, or the vicinity thereof. The capacitive loading conductors 21 and 22 are connected to the ground conductor 19 provided on the other main surface 13, at the lower ends thereof. The widths of the capacitive loading conductors 21 and 22 are made equal to each other, and made smaller than the width of the feeding conductor 20. The length of the capacitive loading conductors 21 is equal to that of the short side of the first side surface 14, in other words, the height of the substrate 11, while the length of the capacitive loading conductors 22 is smaller than that of the capacitive loading conductors 21.

On the second side surface 15 of the substrate 11 opposite to the first side surface 14, as in the case described above, strip shaped capacitive loading conductors 23 and 24 are formed. The capacitive loading conductor 23 situated in the diagonal direction of the radiation conductor 18 with respect to the capacitive loading conductor 21 has the same width and length as those of the capacitive loading conductors 21, and is disposed along the edge line of a short side of the second side surface 15, with the lower end thereof connected to the ground conductor 19. Likewise, the capacitive loading conductor 24 is situated in the diagonal direction of the radiation conductor 18 with respect to the capacitive loading conductor 22, and as in the case of the capacitive loading conductor 22, the length and the width thereof are the same as those of the capacitive loading conductor 22, with one end thereof connected to the ground conductor 19. Here, the third side surface 16 on the left of the first side surface 14 of the substrate 11, and the fourth side surface 17 on the right of the first side surface 14 are not provided with a capacitive loading conductor.

The circularly polarized wave antenna device 10 with the above-described features is surface-mounted on a circuit board (not shown) of radio equipment. In this case, the ground conductor 19 side is soldered to the ground wiring of the circuit board, and the feeding conductor 20 is connected to the antenna terminal of transmitting/receiving circuits formed on the circuit board.

In the radiation conductor 18 of the circularly polarized wave antenna device 10, letting the wavelength of the center frequency of a circularly polarized wave radiated from the radiation conductor 18 be $\lambda$, and the dielectric constant of the substrate 11 be $\in$, the length of the two orthogonally intersecting sides of the radiation conductor 18 is set to be about $\lambda/2\in$. Therefore, by using a dielectric material having a high dielectric constant as the substrate 11, the size of the radiation conductor 18 can be reduced.

The substrate 11 of the circularly polarized wave antenna device 10 is formed of a material having a dielectric constant $\in$ of, for example, 38 to 89. As a ceramic, a dielectric material containing barium oxide, aluminum oxide, and silica as main ingredients is used, or, a magnetic material containing nickel oxide, cobalt oxide, and ferric oxide as main ingredients is employed.

Between the radiation conductor 18 and the feeding conductor 20 of the circularly polarized wave antenna device 10, a stray capacitance is formed based on the gap between the radiation conductor 18 and the feeding conductor 20 and the dielectric constant $\in$ of the substrate 11, which constitute the factors of the stray capacitance, and thereby the radiation conductor 18 and the feeding conductor 20 are capacitively coupled.

Likewise, the radiation conductor 18 and each of the capacitive loading conductors 21, 22, 23, and 24 are also capacitively coupled. However, since the capacitive loading conductors 21 and 23 are different in length than the capacitive loading conductors 22 and 24, the capacitive loading conductors 21 and 23 are different in the load capacitance or electrostatic capacitance than the capacitance loading conductors 22 and 24. When considering the load capacitance or electrostatic capacitance between the radiation conductor 18 and each of the capacitance loading conductors 21, 22, 23, and 24 as a concentrated constant, the electrostatic capacitance C1 between the radiation conductor 18 and each of the capacitance loading conductors 21 and 23, wherein the gaps between the comer portions of the radiation conductor 18 and the tips (upper ends) of the capacitive loading conductors are smaller, becomes larger than the electrostatic capacitance C2 between the comer portion of the radiation conductor 18 and the upper end of each of the capacitive loading conductors 22 and 24. In this configuration, the circularly polarized wave radiated from the radiation conductor 18 become a right-handed spiral circularly polarized wave. Conversely, when setting the electrostatic capacitance C1 between the radiation conductor 18 and each of the capacitive loading conductors 21 and 23 smaller than the electrostatic capacitance C2 between the comer portion of the radiation conductor 18 and the upper end of each of the capacitive loading conductors 22 and 24, the circularly polarized wave becomes a left-handed spiral polarized wave.

Meanwhile, the electrostatic capacitance between the radiation conductor 18 and the ground conductor 19 is a fixed capacitance, and is considered to constitute homogeneous electric lines of force at any position of the radiation conductor 18. Also, the capacitive loading conductors 21 and 22 are connected to the ground conductor 19 and becomes a ground potential. However, since the gap between each of the capacitive loading conductors 21 and 22 and the feeding conductor 20 is large, the electrostatic capacitance between the feeding conductor 20 and each of the capacitive loading conductors 21 and 22 becomes smaller than the load capacitance or the electrostatic capacitance between the radiation conductor 18 and each of the capacitive loading conductors 21, 22, 23, and 24, and the electromagnetic coupling also becomes weak. As a result, the leak of the transmitting signal supplied to the feeding conductor 20 to ground conductor becomes low.

Here, the operation of the circularly polarized wave antenna device 10 will be described. When a transmitting signal is supplied to the feeding conductor 20, the transmitting signal inputted to the radiation conductor 18 is divided at the radiation conductor 18, into two resonant currents in the degeneration-separated mode which have two diagonal directions as the paths thereof. More specifically, since the feeding conductor 20 is disposed so as to equally divide the two diagonal lines 25 and 26 of the radiation conductor 18, the power of the transmitting signal is equally divided and the equal parts are each supplied to the resonant circuits in the two diagonal directions.

Specifically, the transmitting signal supplied to the feeding conductor 20 excites a first high-frequency resonant circuit which has the electrostatic capacitance C1 between the comer portions 18*a* and 18*b* of the radiation conductor 18 and the tips of the capacitive loading conductors 21 and 23 as a circuit element, so that a resonant current having a frequency F1 flows in a first diagonal direction (the direction which connects the comer portion 18*a* to the comer portion 18*b*) 25. Simultaneously, the transmitted signal excites a second resonant circuit which has the electrostatic capacitance C2 between the comer portions 18*c* and 18*d* of the radiation conductor 18 and the capacitive loading conductors 22 and 24 as a circuit element, so that a resonant current having a frequency F2 flows in a second diagonal direction (the direction which connects the comer portions 18*c* to the comer portion 18*d*) 26.

The frequencies F1 and F2 of these two resonant currents are different in the frequency and different in the phase θ by about 90° from each other. The phase difference of the electric fields generated by the two resonant currents becomes about 90°. As described above, since the directions in which the resonant currents flow are the diagonal directions, the two electric fields spatially intersect each other substantially orthogonally. These two electric fields are synthesized into a circularly polarized electromagnetic wave. The resultant electric field vector of the electromagnetic wave is radiated to the space in the normal direction with respect to the radiation conductor 18 while rotating at the intermediate frequency $F_0$ between the resonance frequencies F1 and F2, as a center frequency. The phase of the frequency $F_0$ is different from each of the phases of the frequencies F1 and F2 by about 45°.

Figure 2:
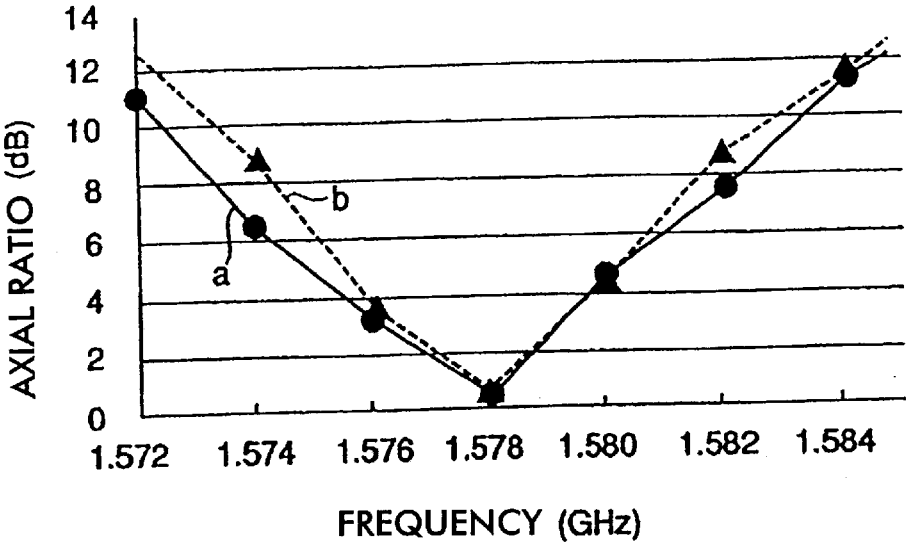
FIG. 2 is a diagram illustrating the relationship between the axial ratio bandwidth and the frequency in the circularly polarized wave antenna device shown in FIG. 1.
Figure 11:
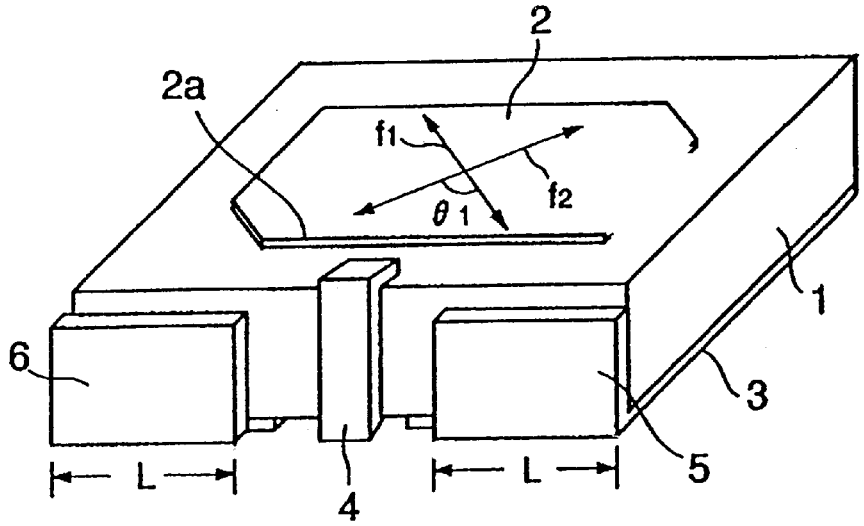
FIG. 11 PRIOR ART
FIG. 11 is a perspective view showing an example of known circularly polarized wave antenna device.

The frequency characteristic of the axial ratio bandwidth at this time is shown in FIG. 2. FIG. 2 represents the ratio between the electric field strength on the major axis and that on the minor axis when the circularly polarized wave is viewed, in a plane, from the normal direction with respect to the radiation conductor 18. Here, the solid line "a" indicates the frequency characteristic of the above-described embodiment, and the broken line "b" indicates that of the embodiment shown in FIG. 11. It can be seen that the configurations of the above-described embodiment allows the bandwidth to be wider than that of the embodiment in FIG. 11.

In the above-described embodiment, the feeding power from the feeding conductor 20 to the radiation conductor 18, can be set to a desired value by varying the gap between the feeding conductor 20 and the radiation conductor 18. Also, the length and width of the capacitive loading conductors 21 and 23, and those of the capacitive loading conductors 22 and 24 are determined in consideration of the frequency characteristic of the circularly polarized wave antenna device.

However, since the capacitive loading conductors 21 and 22, and the capacitive loading conductors 23 and 24 are formed on the same side surfaces 14 and 15, respectively, the phase difference between the two frequencies F1 and F2 do not strictly become 90°. Therefore, the widths of the capacitive loading conductors 21, 22, 23, and 24 are set in consideration of the antenna characteristic so that the error when the phase difference θ between the two resonant frequencies F1 and F2 is set to 90°, becomes within 5° (i.e., $85° \leqq \theta \leqq 95°$).

In order to increase the orthogonality in the space of the two electric fields and to bring the phase difference between the two electric fields close to 90°, each of the capacitive loading conductors 21, 22, 23, and 24 in FIG. 1 may be formed into a strip form along an edge line formed by two side surfaces while utilizing the side surface adjacent thereto. For example, the capacitive loading conductors 21 formed on the first side surface 14 may be disposed astride the fourth side surface 17 side. Specifically, the capacitive loading conductors 21 are formed along the edge line formed by the first side surface and the fourth side surface so that the width and the length of the capacitive loading conductors 21 on both side surfaces are equal. The same goes with the other capacitive loading conductors 22, 23, and 24. With these features, the phase difference θ between the two electric fields becomes 90°, and the two electric fields spatially intersect each other orthogonally, thus constituting circularly polarized waves.

In FIG. 1, the capacitive loading conductors 21, 22, 23, and 24 have been disposed on the first and fourth side surfaces 14 and 15, but only one of the first and second side surfaces 14 and 15 may be provided with two capacitive loading conductors 21 and 22, or two capacitive loading conductors 23 and 24. In this case also, the two resonant currents in the degeneration-separated mode flow through the radiation conductor 18, but the load capacitance or the electrostatic capacitance between the radiation conductor 18 and each of the capacitive loading conductors 21 and 22, or between the radiation conductor 18 and each of the capacitive loading conductors 23 and 24 becomes smaller, and the frequency of the electromagnetic wave radiated as circularly polarized wave becomes higher. In order to obtain the same frequency as the case where the four capacitive loading conductors 21, 22, 23, and 24 are provided as in FIG. 1, it is necessary to make longer the capacitive loading conductors 21 and 22, or the capacitive loading conductors 23 and 24, and to make larger the load capacitive or the electrostatic capacitance between the radiation conductor 18 and each of the capacitive loading conductors 21 and 22, or between the radiation conductor 18 and each of the capacitive loading conductors 2 3 and 2 4.

On the first and second side surfaces 14 and 15 of the substrate 11, the two capacitive loading conductors 21 and 24, or the two capacitive loading conductors 22 and 23 may be disposed at positions which are not diagonal positions. In this case also, as in the case described above, two resonant currents in a mode degeneration-separated by the signal supplied from the feeding conductor 18 flow.

The capacitive loading conductors 21, 22, 23, and 24 shown in FIG. 1 may be disposed on the third and fourth side surfaces 16 and 17 instead of disposing on the first and second side surfaces 14 and 15. The functions as antennas are identical to the above-described case.

Figure 3:
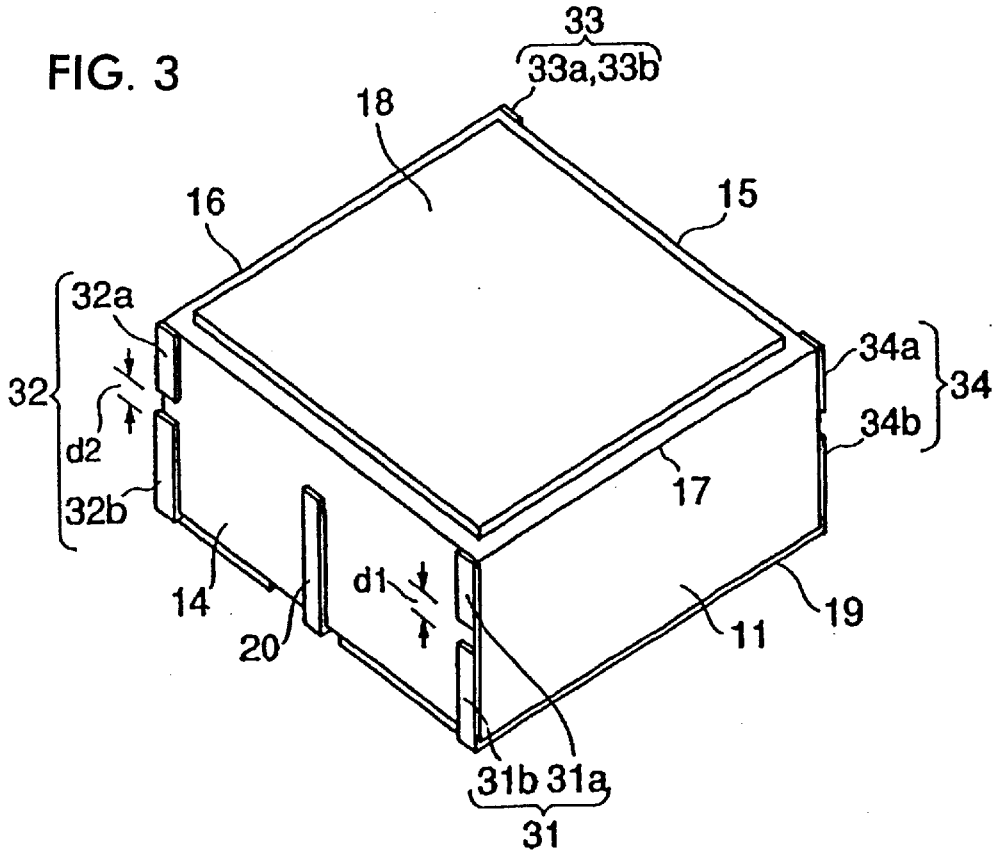
FIG. 3 is a perspective view showing a circularly polarized wave antenna device in accordance with a second embodiment of the present invention.

FIG. 3 shows a circularly polarized wave antenna device in accordance with a second embodiment of the present invention. Here, the same components as those in FIG. 1 are given the same reference numerals, and repeated descriptions of common components will be omitted. The second embodiment differs from the first embodiment shown in FIG. 1 in the configuration of the capacitive loading conductors. Strip shaped capacitive loading conductors 31 and 32 disposed along the edge lines of the short sides of the first side surface 14 are formed so as to be divided into upper half pieces 31*a* and 32*a* of capacitive loading conductor and lower half pieces 31*b* and 32*b* thereof, respectively, and the upper and lower half pieces of each of the capacitive loading conductors are positioned on the upper side and the lower side with a gap therebetween.

More specifically, the lower ends of the capacitive loading conductor lower pieces 31*b* and 32*b* are connected to the ground conductor 19, and the upper ends of the capacitive loading conductor upper pieces 31*a* and 32*a* are positioned flush with the one main surface 12. Gaps are formed between the capacitive loading conductor upper pieces 31*a* and 32*a* and the capacitive loading conductor lower pieces 31*b* and 32*b*, respectively, and the gap d1 between the capacitive loading conductor upper pieces 31*a* and the capacitive loading conductor lower pieces 31*b* is formed smaller than the gap d2 between the capacitive loading conductor upper pieces 32*a* and the capacitive loading conductor lower pieces 32*b*.

The same is true with the capacitive loading conductors 33 and 34 disposed along the edge lines of the short sides of the second side surface 15. Capacitive loading conductor upper and lower pieces 33*a* and 33*b* situated in the diagonal direction of the radiation conductor 18 have the same configuration as that of the capacitive loading conductor upper and lower pieces 31*a* and 31*b*, and are positioned on the upper side and the lower side with a gap d1 therebetween. Likewise, capacitive loading conductor upper and lower pieces 34*a* and 34*b* situated in a diagonal direction of the radiation conductor 18 have the same configuration as that of the capacitive loading conductor upper and lower pieces 32*a* and 32*b*, and are positioned on the upper side and the lower side with a gap d2 therebetween. The gaps between the capacitive loading conductor upper pieces 31*a*, 32*a*, 33*a*, and 34*a* and the radiation conductor 18 are equal to one another.

In the second embodiment, two resonant currents in the mode degeneration-separated by the signal supplied to the feeding conductor 20 flow, and thereby electric fields which have a phase difference of about 90° therebetween, and which spatially intersect each other substantially orthogonally occurs. The frequency difference between the two resonant currents flowing in the diagonal directions of the radiation conductor 18 is determined by the capacitances between the capacitive loading conductor upper pieces 31*a*, 32*a*, 33*a* and 34*a*, and the respective capacitive loading conductor lower pieces 31*b*, 32*b*, 33*b*, and 34*b*, and the frequency of the resonant current in the direction connecting the capacitive loading conductor 31 and 33 becomes lower than that of the resonant current in the direction connecting capacitive loading conductor 32 and 34. The phase difference between the two resonant frequencies becomes about 90°, as in the case of the first embodiment.

Figure 4:
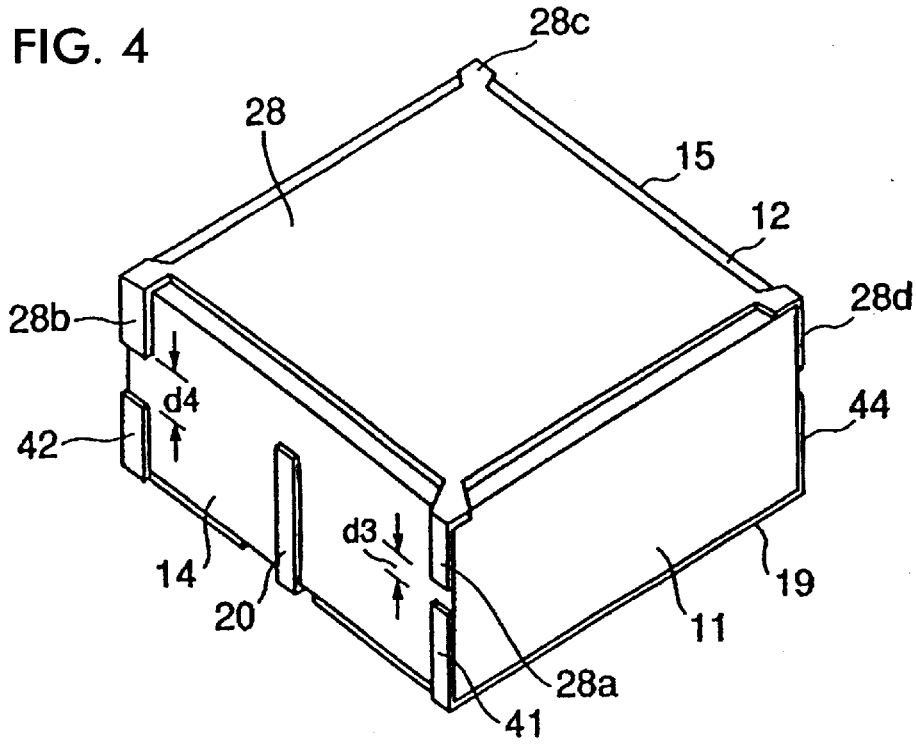
FIG. 4 is a perspective view showing a circularly polarized wave antenna device in accordance with a third embodiment of the present invention.

FIG. 4 shows a circularly polarized wave antenna device in accordance with a third embodiment of the present invention. Here, the same components as those in FIG. 1 are given the same reference numerals, and repeated descriptions of common components will be omitted. The third embodiment is characterized in that radiation conductor extension portions 28*a*, 28*b*, 28*c*, and 28*d* are provided at the corner portions of a radiation conductor 28 having a square shape in a plan view, and that capacitive loading conductors 41, 42, 43, and 44 connected to the ground conductor 19 are formed, with gaps interposed between these capacitive loading conductors and the above-described radiation conductor extension portions.

The radiation conductor extension portions 28*a*, 28*b*, 28*c*, and 28*d* are formed so that the corner portions of the radiation conductor 28 are extended to the corner portions of the one main surface 12 of the substrate 11, and further extended downward along the edge lines of the short sides of the first and second side surface 14 and 15, and the width thereof is the same as that of the capacitive loading conductors 41, 42, 43, and 44. The gap d3 between the radiation conductor extension portions 28*a* and the capacitive loading conductor 41 is made smaller than the gap d4 between the radiation conductor extension portions 28*b* and the capacitive loading conductor 42. The radiation conductor extension portions 28*a* and 28*c* in a diagonal direction of the radiation conductor 28 have the same configuration, and likewise, the radiation conductor extension portions 28*b* and 28*d* are configured in the same manner. Also, the capacitive loading conductor 41 and the capacitive loading conductor 43 (not shown) have the same configuration, and the capacitive loading conductors 42 and 44 have the same configuration, as well.

In the third embodiment, as in the case of the first embodiment, resonant currents in the degeneration-separated mode generate two electric fields which have a phase difference of about 90° therebetween, and which spatially intersect each other substantially orthogonally, thereby achieving an antenna which radiates circularly polarized electromagnetic waves. The phase difference between the two resonant frequencies is about 90°. As is the case with the first embodiment, the frequencies of the two electric fields are determined by the electrostatic capacitances between the radiation conductor extension portions 28*a* and 28*c* and the respective capacitive loading conductors 41 and 43, and those between the radiation conductor extension portions 28*b* and 28*d* and the respective capacitive loading conductors 42 and 44.

Figure 5:
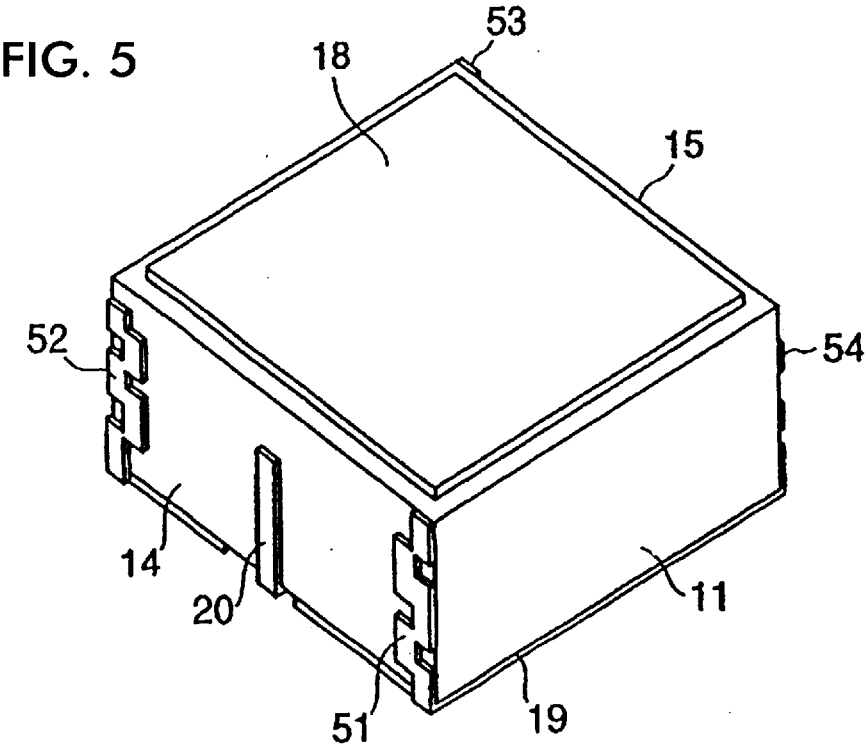
FIG. 5 is a perspective view showing a circularly polarized wave antenna device in accordance with a fourth embodiment of the present invention.

FIG. 5 shows a circularly polarized wave antenna device in accordance with a fourth embodiment of the present invention. Here, the same components as those in FIG. 1 are given the same reference numerals, and repeated descriptions of common components will be omitted. The fourth embodiment differs from the first embodiment in that capacitive loading conductors 51, 52, 53, and 54 are not formed linearly, but formed into a meander shape, that is, formed so as to be meandering on the same plans. Each of the capacitive loading conductors 51 and 52 are formed along one of the edge lines of the short side of the first side surface 14, and the capacitance loading conductors 53 and 54 are formed in the same manner on the second side surface 15. The positions of these capacitive loading conductors correspond to the extended positions of the diagonal lines of the radiation conductor 18.

The gap between the tip of each of the capacitive loading conductors 51 and 53 and the radiation conductor 18 is smaller than that between the tip of each of the capacitive loading conductors 52 and 54 and the radiation conductor 18. When each of the capacitive loading conductors 51, 52, 53, and 54 is formed into a meander shape, the area thereof increases, and thereby the load capacitance or the electrostatic capacitance between each of the capacitive loading conductors 51, 52, 53, and 54 and the radiation conductor 18 increases. Accordingly, the width of each of the capacitive loading conductors 51, 52, 53, and 54 are made smaller than that of each of the capacitive loading conductors 21, 22, 23, and 24 in the first embodiment.

In accordance with the fourth embodiment, each of the capacitive loading conductors 51, 52, 53, and 54 has an inductance in itself, and thereby decreases the resonant frequencies of the two resonant currents in the degeneration-separated mode in cooperation with the capacitive component (load capacitance or electrostatic capacitance) between the radiation conductor 18 and each of the capacitive loading conductors 51, 52, 53, and 54. Therefore, the frequency of the circularly polarized electromagnetic wave radiated can be decreased.

Figure 6:
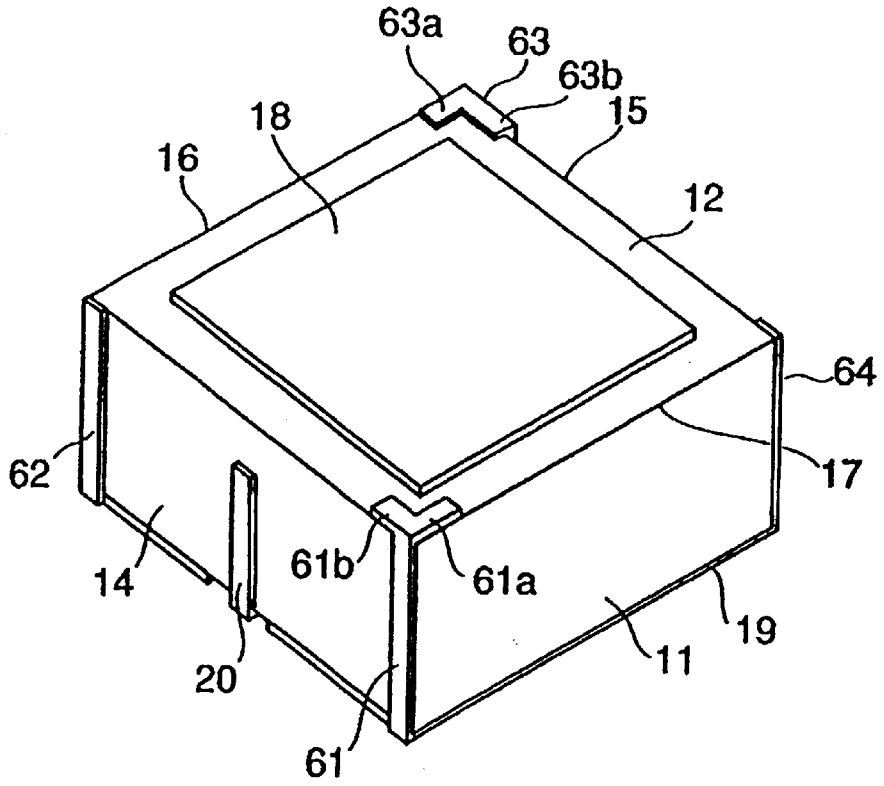
FIG. 6 is a perspective view showing a circularly polarized wave antenna device in accordance with a fifth embodiment of the present invention.

FIG. 6 shows a circularly polarized wave antenna device in accordance with a fifth embodiment of the present invention. Here, the same components as those in FIG. 1 are given the same reference numerals, and repeated descriptions of common components will be omitted. The fifth embodiment is characterized in that at least one capacitive loading conductor extends from the first side surface 14 of the substrate 11 and the second side surface 15 to the one main surface 12 on which the radiation conductor 18 is formed.

A capacitive loading conductor 61 disposed along a short side of the first side surface 14 is connected to the ground conductor 19 at the lower end thereof. The upper end of the capacitive loading conductor 61 extends up to the one main surface 12, exceeding the edge lines formed by the first side surface 14 and the one main surface 12, and bifurcates on the main surface 12 into bifurcate portions 61*a* and 61*b*. Each of the bifurcate portions 61*a* and 61*b* has a specific length along the edge line of the one main surface, and the side thereof facing the comer portion of the radiation conductor 18 is parallel to the edge line of the radiation conductor 18.

Bifurcate portions 63*a* and 63*b* are also provided to the capacitive loading conductor 63 on the second side surface 15 situated in the diagonal direction of the radiation 18 with respect to the capacitive loading conductor 61, and the configuration thereof is the same as that of the capacitive loading conductor 61. Also, a capacitive loading conductor 62 disposed along another short side of the first side surface 14, and the capacitive loading conductor 64 on the second side surface 15 situated in the diagonal position of the capacitive loading conductor 62, are each connected to the ground conductor 19 at the lower end thereof, and the length thereof is the same as that of the short sides of the side surfaces.

In the above-described fifth embodiment, the electrostatic capacitance between each of the capacitive loading conductors 61, 62, 63, and 64 and the radiation conductor 18 is larger than in the case of the capacitive loading conductor 21, 22, 23, and 24, so that the resonant frequencies of the two resonance currents in the degeneration-separated mode become lower than in the case of the antenna in the first embodiment.

Figure 7:
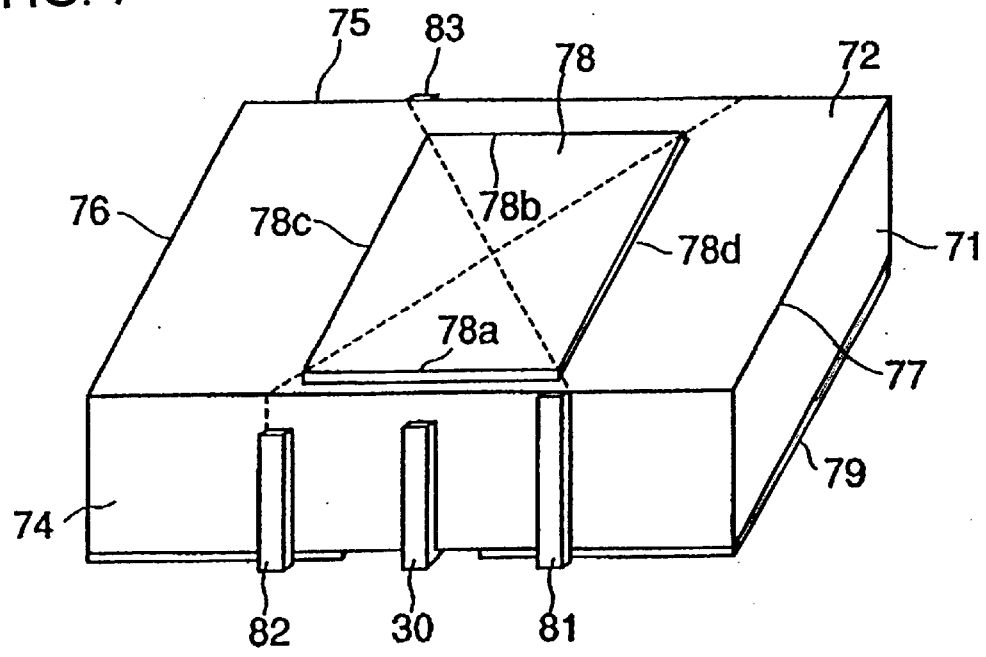
FIG. 7 is a perspective view showing a circularly polarized wave antenna device in accordance with a sixth embodiment of the present invention.

FIG. 7 shows a circularly polarized wave antenna device in accordance with a sixth embodiment of the present invention. In this circularly polarized wave antenna device, a substrate 71 having a rectangular parallelepiped shape. On one main surface 72 of the substrate 71, a radiation conductor 78 having a square shape in a plan view is formed. The gaps between the two opposing sides 78*a* and 78*b* of the radiation conductor 78 and the long sides (or, the first and second side surfaces 74 and 75) of the substrate 71 are smaller than those between the two other sides 78*c* and 78*d* of the radiation conductor 78 and the short sides (or, the third and fourth side surfaces 76 and 77) of the substrate 71. That is, the two opposing sides 78*a* and 78*b* of the radiation conductor 78 are disposed closer to the first and second side surface 74 and 75, respectively.

A ground conductor 79 is formed substantially over the entire surface of the other main surface 73 of the substrate 71, except for the lower end portion of the feeding conductor 30 provided on the first side surface 74. A feeding conductor 30 having the same configuration as that of the feeding conductor 20 in the first embodiment, is formed on the first side surface 74 of the substrate 71. Capacitive loading conductors 81 and 82 are formed on side surface positions to which the diagonal lines of the radiation conductor 78 are extended. The length of the capacitive loading conductors 82 is made shorter than that of the capacitive loading conductor 81, and the same is true for the capacitive loading conductors 83 and the capacitive loading conductors 84 (not shown) each formed on the second surface side 75.

In the circularly polarized wave antenna device in accordance with the sixth embodiment also, since the radiation conductor 78 is formed so that the electric lengths in the diagonal directions are equal to each other, the circularly polarized wave antenna device in accordance with the sixth embodiment functions in the same manner as the antenna in the first embodiment. That is, two resonant currents in the mode degeneration-separated by the signal supplied to the feeding conductor 30, and which has a mutual phase difference of about 90°, flow, thereby radiating circularly polarized electromagnetic waves.

Figure 8:
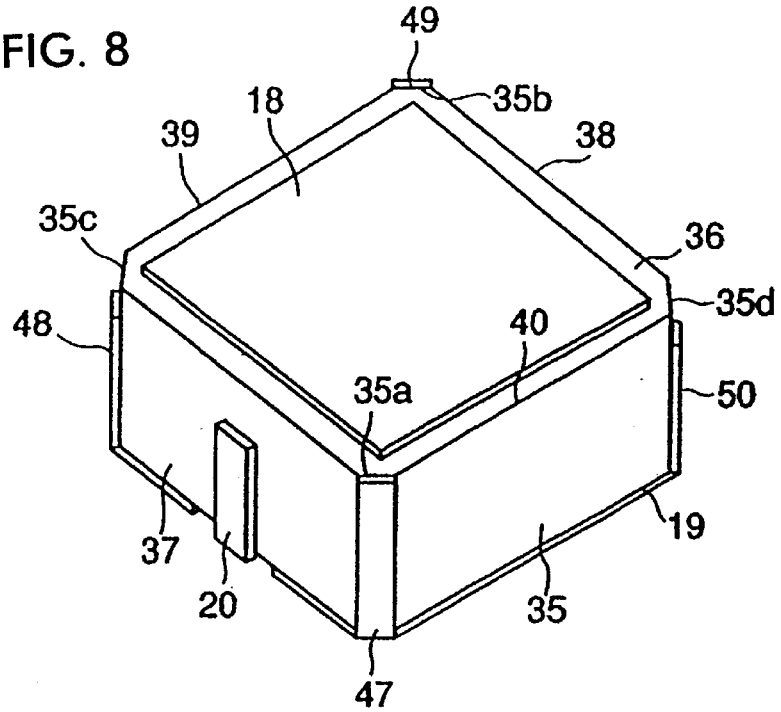
FIG. 8 is a perspective view showing a circularly polarized wave antenna device in accordance with a seventh embodiment of the present invention.

FIG. 8 shows a circularly polarized wave antenna device in accordance with a seventh embodiment of the present invention. Here, the same components as those in FIG. 1 are given the same reference numerals, and repeated descriptions of common components will be omitted. The seventh embodiment differs from the first embodiment in that conductor forming surfaces 35*a*, 35*b*, 35*c*, and 35d are provided on a substrate 35, and capacitive loading conductors 47, 48, 49, and 50 are formed on these conductor forming surfaces 35*a*, 35*b*, 35*c*, and 35*d*.

More specifically, the substrate 35 is cut away at each of the corner portions of a main surface 36 having a substantially square shape by a plane perpendicular to the extension line of a diagonal line, and thereby the conductor forming surfaces 35*a*, 35*b*, 35*c*, and 35*d* are formed among adjacent side surfaces 37 and 40; 39 and 38; 37 and 39; and 40 and 38, respectively. On these conductor forming surfaces 35*a*, 35*b*, 35*c*, and 35*d*, strip shaped capacitive loading conductors 47, 49, 48, and 50 are disposed. The length of the capacitive loading conductors 48 and 50 is shorter than that of the capacitive loading conductors 47 and 49, but all of the capacitive loading conductors 47, 48, 49, and 50 have the same width.

In the seventh embodiment, since the capacitive loading conductors 47, 48, 49, and 50 are positioned correctly on the extension lines of diagonal lines of the radiation conductor 18, the signal supplied from the feeding conductor 20 to the radiation conductor 18 comes into the degeneration-separated mode having a phase angle of just 90°. As in the case of the first embodiment, the difference in the resonant frequency of the two resonant currents excited in the diagonal directions of the radiation conductor 18 is determined by the value of the load capacitance or the electrostatic capacitance between the radiation conductor 18 and each of the capacitive loading conductors 47, 48, 49, and 50. Circularly polarized electromagnetic waves are radiated from the radiation conductor 18 using the two resonant currents as an exciting source, and the center frequency thereof and the resonant frequency has a phase difference of 45° therebetween, thereby improving the axial ratio bandwidth characteristic.

Figure 9:
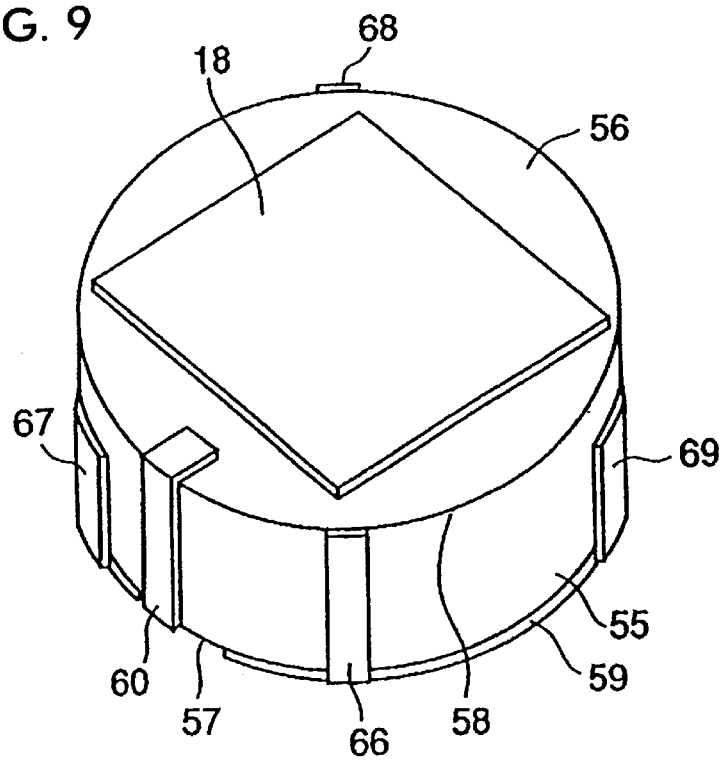
FIG. 9 is a perspective view showing a circularly polarized wave antenna device in accordance with an eighth embodiment of the present invention.

FIG. 9 shows a circularly polarized wave antenna device in accordance with an eighth embodiment of the present invention. The circularly polarized wave antenna device in accordance with the eighth embodiment is configured using a disk shaped substrate 55 constituted of a dielectric body. As in the case of the first embodiment, a radiation conductor 18 having a square shape in a plan view is formed on the top main surface 56 of the substrate 55. On the peripheral side surface 58 of the substrate 55, a strip shaped feeding conductor 60 is formed so as to extend in the thickness direction of the substrate and further to wrap around the top main surface 56. A ground conductor 59 is formed substantially over the entire surface of the bottom main surface 57 of the substrate 55 except for the lower end portion of the feeding conductor 60. Capacitive loading conductors 66, 67, 68, and 69, of which the lower ends are connected to the ground conductor 59, are formed at the positions on the peripheral side surface 58 in the diagonal directions of the radiation conductor 18. The capacitive loading conductors 67 and 69 are formed shorter than the capacitive loading conductors 66 and 68.

As in the case with the above-described seventh embodiment, in the eighth embodiment, the signal supplied from the feeding conductor 60 come into the degeneration-separated mode in the radiation conductor 18, the two electric fields have a phase difference of just 90° therebetween, and spatially intersect each other orthogonally. Hence, a circularly polarized wave radiated from the radiation conductor 18 become substantially a perfect circle when viewed, in a plane, from the radiation direction. The frequencies of the two electric fields are subjected to the influences of the load capacitance or the electrostatic capacitance between the capacitive loading conductor 66 and 68 and the respective comer portions of the radiation conductor 18, or those of the load capacitance or the electrostatic capacitance between the capacitive loading conductor 67 and 69 and the respective comer portions of the radiation conductor 18.

In the first to eighth embodiments described above, examples using four strip-shaped capacitive loading conductors have been explained. Alternatively, however, a configuration using two capacitive loading conductors may be used, so long as the configuration is one wherein the impedances in two diagonal lines of the radiation conductor differ from each other. The choice of which to use is determined by the required antenna characteristic.

Figure 10:
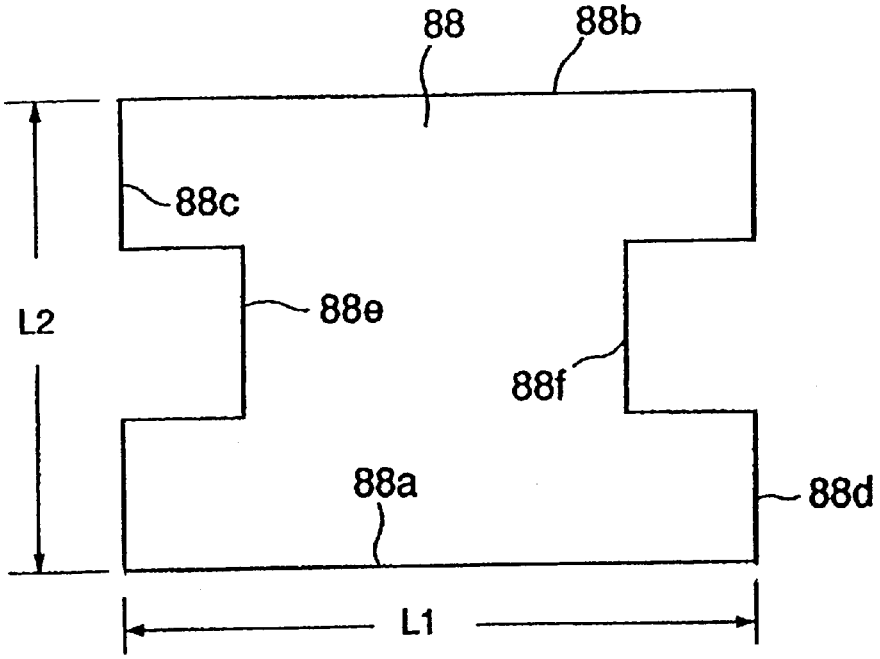
FIG. 10 is a plan view showing a second embodiment of a radiation conductor used in a circularly polarized wave antenna device in accordance with the present invention.

The radiation conductor has been described as having a square shape in a plan view, but the radiation conductor may be formed into an electrically square shape in a plan view as shown in FIG. 10, so long as the electrical length in the mutually orthogonal directions are equal. In FIG. 10, the radiation conductor 88 is configured in a manner such as to form concave portions 88*e* and 88*f* by cutting out concavities from two parallel sides 88*c* and 88*d*, and by forming the entire body thereof into a rectangular bobbin shape in a plan view, wherein the electrical lengths L1 and L2 along the edge lines of the two orthogonal sides 88*a* and 88*c* are configured to be equal to each other (i.e., L1=L2).

In this radiation conductor 88, the position of a feeding conductor (not shown) is not limited, but the position of the feeding conductor may be any one of the sides 88*a* and 88*b* sides, or any one of the sides 88*c* and 88*d* sides on which the concave portions 88*e* and 88*f* are provided. When the radiation conductor 88 is supplied with a signal from the feeding conductor, resonant currents in the degeneration-separated mode flow in the two diagonal directions of the radiation conductor 88 by providing capacitive loading conductors having configurations and dispositions as shown in the above-described embodiments. Since the radiation conductor 88 is formed so that the electric lengths L1 and L2 of the two orthogonal sides are equal, the radiation conductor 88 is electrically square in a plan view, and the two diagonal lines by visual observation are electrically orthogonal diagonal lines, so that the phase difference between two resonant currents in degeneration-separated mode becomes 90°. Also, since the directions in which the two resonant currents flow are the ones which are electrically orthogonal to each other, it is possible to excite two electric fields which spatially intersect each other orthogonally.

As is evident from the foregoing, in accordance with the circularly polarized wave antenna device of the present invention, since there are provided capacitive loading conductors which generate different values of load capacitances between these capacitive loading conductors and the radiation conductor, two resonant currents degeneration-separated are excited by the transmitting signal inputted from the feeding conductor to the radiation conductor, thereby two electric fields (polarized waves) which uses the resonant currents as an exciting source, have a mutual phase difference of about 90°, and the two electric fields spatially intersect each other substantially orthogonally. Thereby, the two electric field are prevented from mutual interference, and the inter-electric field separation characteristic is enhanced, so that the antenna gain and the bandwidth are improved, resulting in a significantly improved axial ratio bandwidth.

Also, in accordance with the circularly polarized wave antenna device of the present invention, since the radiation conductor is formed as a square shape or an electrically square shape in plan view, and capacitive loading conductors having mutually different shapes are disposed close to the radiation conductor at the position based on the extended lines of the two diagonal lines on the radiation conductor, two electric fields in the degeneration-separated mode which have a phase difference of about 90° therebetween are excited, and these two electric fields in the degeneration-separated mode can be spatially made to intersect each other substantially orthogonally, thereby improving the antenna characteristic of circularly polarized waves.

Furthermore, in accordance with the circularly polarized wave antenna device of the present invention, by disposing capacitive loading conductors having the same length on the opposite sides in the same diagonal direction of the radiation conductor and simultaneously by making different the length dimensions of the capacitive loading conductors in the different diagonal directions, the frequencies of the two electric fields in the degeneration- separated mode can be varied. Thus, since the load capacitance can be varied by selecting the configuration of the capacitive loading conductor, it is possible to design the center frequency of circularly polarized waves radiated from the circularly polarized wave antenna device to be a high or low value, without deteriorating the antenna characteristic, resulting in an improved versatility in the design.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications that fall within the true spirit and scope of the invention.

What is claimed is:

1. A circularly polarized wave antenna device, comprising:

a substrate comprising a dielectric material;

a radiation conductor having a quadrilateral shape in a plan view, said radiation conductor being disposed on a first main surface of said substrate;

a ground conductor disposed on a second main surface of said substrate, said second main surface being opposed to said radiation conductor;

a feeding conductor disposed on said substrate so as to extend from said second main surface toward said first main surface;

said radiation conductor having a shape wherein electric lengths in two orthogonal directions on said radiation conductor are equal to each other; and capacitive loading conductors provided at positions in diagonal directions of said radiation conductor on said substrate, and which generate load capacitance between said radiation conductor and said capacitive loading conductors, said load capacitance determining a frequency difference between two resonant currents flowing through said radiation conductor.

2. The circularly polarized wave antenna device of claim 1, wherein:

said substrate comprises a hexahedron having two main surfaces and four side surfaces;

each of said capacitive loading conductors is disposed on a first side surface on which said feeding conductor is provided, along an edge line between said first side surface and a side surface adjacent thereto, and a length of a first of said capacitive loading conductors of which one end is connected to said ground conductor, is shorter than a length of a second of said capacitive loading conductors; and on a second side surface opposite the first side surface on which said feeding conductor is provided, capacitive loading conductors each having the same length as that of a respective capacitive loading conductor in a diagonal direction on said main surface, are each disposed along an edge line between said second side surface and a side surface adjacent thereto.

3. The circularly polarized wave antenna device of claim 1, wherein each of said capacitive loading conductors is divided into a plurality of capacitive loading conductor pieces with gaps interposed therebetween.

4. The circularly polarized wave antenna device of claim 1, wherein:

said radiation conductor has radiation conductor extension pieces each extending downward from a comer portion of said radiation conductor along an edge line between side surfaces adjacent to each other; and said radiation conductor extension pieces are formed so as to have mutually different gaps between said radiation conductor extension pieces and said capacitive loading conductors, between different ones of said diagonal directions.

5. The circularly polarized wave antenna device of claim 1, wherein at least one of said capacitive loading conductors extends to the first main surface on which said radiation conductor is disposed.

6. The circularly polarized wave antenna device of claim 1, wherein each of said capacitive loading conductors has a meander shape.

7. The circularly polarized wave antenna device of claim 1, wherein said substrate comprises a rectangular parallelepiped.

8. The circularly polarized wave antenna of claim 7, wherein corners of said substrate are cut away at an angle and said capacitive loading conductors are disposed at said corners.

9. The circularly polarized wave antenna of claim 1, wherein at least one of said capacitive loading conductors extends onto said first main surface capacitively isolated from said radiation conductor by a gap.

10. The circularly polarized wave antenna device of claim 1, wherein the substrate is circular in plan view.

11. A circularly polarized wave antenna device, comprising:

a substrate comprising a dielectric material;

a radiation conductor disposed on a first main surface of said substrate;

a ground conductor disposed a second main surface of said substrate, said second main surface being opposed to said radiation conductor;

a feeding conductor disposed on a side surface of said substrate so as to extend from said second main surface toward said first main surface;

said radiation conductor comprising at least one of a square shape in a plan view and an electrically square shape in a plan view; and capacitive loading conductors provided at least one of at extended positions of two diagonal lines on said radiation conductor in the vicinity thereof, on said substrate, said capacitive loading conductors being disposed between said ground conductor and said radiation conductor, and having mutually different shapes between said two diagonal directions.

12. The circularly polarized wave antenna device of claim 11, wherein:

said substrate comprises a hexahedron having two main surfaces and four side surfaces;

each of said capacitive loading conductors is disposed on a first side surface on which said feeding conductor is provided, along an edge line between said first side surface and a side surface adjacent thereto, and a length of a first of said capacitive loading conductors of which one end is connected to said ground conductor, is shorter than a length of a second of said capacitive loading conductors; and on a second side surface opposite the first side surface on which said feeding conductor is provided, capacitive loading conductors each having the same length as that of a respective capacitive loading conductor in a diagonal direction on said main surface, are each disposed along an edge line between said second side surface and a side surface adjacent thereto.

13. The circularly polarized wave antenna device of claim 11, wherein each of said capacitive loading conductors is divided into a plurality of capacitive loading conductor pieces with gaps interposed therebetween.

14. The circularly polarized wave antenna device of claim 11, wherein:

said radiation conductor has radiation conductor extension pieces each extending downward from a comer portion of said radiation conductor along an edge line between side surfaces adjacent to each other; and said radiation conductor extension pieces are formed so as to have mutually different gaps between said radiation conductor extension pieces and said capacitive loading conductors, between different ones of said diagonal directions.

15. The circularly polarized wave antenna device of claim 11, wherein at least one of said capacitive loading conductors extends to the first main surface on which said radiation conductor is disposed.

16. The circularly polarized wave antenna device of claim 11, wherein each of said capacitive loading conductors has a meander shape.

17. The circularly polarized wave antenna device of claim 11, wherein said substrate comprises a rectangular parallelepiped.

18. The circularly polarized wave antenna of claim 17, wherein comers of said substrate are cut away at an angle and said capacitive loading condutors are disposed at said comers.

19. The circularly polarized wave antenna of claim 11, wherein at least one of said capacitive loading conductors extend onto said first main surface isolated from said radiation conductor by a gap.

20. The circularly polarized wave antenna device of claim 11, wherein the substrate is circular in plan view.

* * * * *